US006460761B1

(12) United States Patent
Fraga et al.

(10) Patent No.: US 6,460,761 B1
(45) Date of Patent: Oct. 8, 2002

(54) CHILD-PROOF RECEPTACLE APPARATUS AND METHOD

(76) Inventors: Esteban Eduardo Fraga, 4740 Connecticut Ave., NW, Apt. 207A, Washington, DC (US) 20008; Alfredo Mauricio Fraga, 3211 B Sutton Pl., Northwest, Washington, DC (US) 20016

( * ) Notice: Subject to any disclaimer, the term of this patent is extended or adjusted under 35 U.S.C. 154(b) by 0 days.

(21) Appl. No.: 09/447,669

(22) Filed: Nov. 23, 1999

(51) Int. Cl.[7] ..... B65D 91/00

(52) U.S. Cl. ..... 232/43.1; 232/44; 232/43.5; 220/86.1

(58) Field of Search ..... 232/43.1, 43.4, 232/43.5, 44, 4 R, 7; 220/86.1; 206/807; 141/331, 338, 340

(56) References Cited

U.S. PATENT DOCUMENTS

| | | | | |
|---|---|---|---|---|
| 321,877 | A | | 7/1885 | Abell |
| 773,960 | A | * | 11/1904 | Moore |
| 1,719,925 | A | | 7/1929 | Cruess |
| 1,988,736 | A | | 1/1935 | Jacobs |
| 2,595,103 | A | | 4/1952 | Schmaling |
| 2,674,395 | A | | 4/1954 | Ravlin |
| 2,786,595 | A | | 3/1957 | Nelson |
| 2,797,136 | A | | 6/1957 | Nelson |
| 2,883,057 | A | | 4/1959 | Richards |
| 2,962,181 | A | | 11/1960 | Nelson |
| 4,756,406 | A | | 7/1988 | Grounds |
| 5,607,004 | A | | 3/1997 | Cope |
| 5,971,194 | A | * | 10/1999 | Freedland |

* cited by examiner

*Primary Examiner*—B. Dayoan
*Assistant Examiner*—William L. Miller
(74) *Attorney, Agent, or Firm*—Jacobson Holman, PLLC

(57) ABSTRACT

A child-proof storage receptacle including a canister and-a preferably funnel-shaped insert detachably secured to the canister at an open top of the canister. The funnel-shaped insert is detachably secured to the canister by a child-proof locking mechanism. The funnel tapers to an opening sized to receive the objects to be retained within said canister. In one embodiment, a plate is positioned within the canister and spaced below the funnel-shaped insert opening, and above the canister bottom wall to intercept objects deposited into the funnel-shaped insert that pass through the opening. The plate is preferably circular and inclined. The plate includes a lip about its periphery. In other embodiments the funnel-shaped insert includes a cap or flap pivotably mounted adjacent the opening to close off the opening, at least when the canister is inverted. Objects intended to be retained within the canister and inaccessible to a small child will be deposited into the insert, roll or fall down the funnel through the opening to be retained therebelow. Large objects will be retained in the insert.

17 Claims, 6 Drawing Sheets

CHILD-PROOF RECEPTACLE APPARATUS AND METHOD

BACKGROUND OF THE INVENTION

The present invention relates generally to a child-proof receptacle for storing relatively small objects to be retained within the receptacle without access by a small child.

Small children, such as infants, have a propensity to place objects in their mouth including small objects which can lodge in the throat or be swallowed with obviously severe consequences. Parents or other child care givers must either closely monitor the child during play or be certain to remove all objects out of the child's reach. There is thus a clear need for some article or apparatus that would retain the small dangerous objects so as to be inaccessible to small children yet enable children to play with larger objects that are of less concern to be swallowed.

SUMMARY OF THE INVENTION

The present invention is directed to a child-proof storage receptacle comprising a canister, preferably cylindrically-shaped similar in exterior appearance to a waste basket, having a bottom wall or surface that may rest on a floor or other support and having an open top to receive an insert. An insert having a downwardly inclined region such as a funnel-shaped insert is placed within the canister and is detachably secured or locked to the canister adjacent the open top in a child-proof manner. That is, the insert is locked to the canister sufficiently secure so that a small child cannot separate or remove the funnel-shaped insert from the canister and thus have access to the canister interior which receives the objects to be stored out of harm's way. The preferably funnel-shaped insert tapers to an opening sized to receive the objects that are to be retained within the canister. That is, small objects that are sized to freely pass through the opening, when deposited in the insert, will fall down the insert, through the opening and into the canister to be captured within the canister. A child will be unable to put his or her hand through the opening to retrieve the small object and thus the child will be safe from swallowing the object.

The funnel-shaped insert includes a substantially cylindrically-shaped integral extension from the edge of the opening extending downward into the canister interior. The free end of the extension may be angled to define an angled planar opening facing the canister interior.

The invention includes several distinct embodiments as will be described. In at least one embodiment, the funnel-shaped insert opening remains open even when the storage receptacle canister is inverted. When inverted, there is a remote potential that the small objects could fall out of the opening. However, the canister and insert geometry of this embodiment can be designed to minimize such occurrence. Steps can also be taken to ensure that the lifting of the receptacle by a small child is remote. For example, the receptacle may be constructed to be relatively heavy compared to the strength of a small child and of a particular size that makes the grasping and turning the receptacle over for shaking extremely remote.

In this first embodiment, the storage receptacle includes a plate that is positioned within the canister, spaced below the insert opening, and above the canister bottom wall, so as to intercept objects deposited into the insert that then roll or fall downwardly and pass through the opening. The plate is preferably flat, i.e. planar, and is angled or inclined relative to the major axis of the insert. The plate preferably has a circular perimeter that includes a lip that extends in an upward direction. The plate also includes raised indentations or rod-like elements to act as ramps for the small objects to jump over the lip as well as some raised projections to create obstacles to change the trajectory of the small objects and to assist the objects to fall into the canister.

The plate is preferably of a predetermined diameter and is positioned a predetermined distance below the funnel-shaped insert opening and the lip is of a predetermined dimension so as to retain relatively larger elongated objects so that they extend out from the opening into the insert area so that such elongated objects may be grasped by a child. That is, the elongated objects will not fall completely through the opening. Similarly, the plate is inclined or angled with respect to the major axis of the insert so as to enable those objects that are to be retained within the canister to fall down the plate at a sufficient velocity so as to jump over the lip. By adjusting the size of the opening, the height of the substantially cylindrical extension of the insert, the free-end angle of the extension, the position and diameter of the plate and its orientation, the height of the lip, and other variables to be described, the child-proof receptacle can be designed so that objects of a predetermined relatively small size will fall through the opening and be captured within the canister, whereas relatively large sized objects will be retained in the insert, and where objects of relatively elongated configuration can be retained by the plate and extend outward from the opening into the insert so as to be retrievable by a parent.

In other preferred embodiments of the invention, the circular plate is eliminated in its entirety and the insert, preferably conical or funnel-shaped, includes a cap or flap positioned adjacent the free end of the substantially cylindrical extension which automatically closes the opening defined by the free end when the canister is inverted. Two distinct embodiments are described including one embodiment where the flap seats on the free end opening by a spring-loaded mechanism and another embodiment where the flap seats on the opening solely by the force of gravity when the canister is inverted. In each of these embodiments, small objects within the canister cannot be removed from the canister by simply inverting and shaking the canister since doing so will seal off the opening. In each of these embodiments, elongated objects will not be retained to extend outwardly from the opening into the insert so as to be retrievable.

Thus, it is an object of the present invention to provide a child-proof receptacle to secure, confine, and capture small objects that are intended to be kept inaccessible to a small child so as to prevent the child from swallowing the objects. It is an object of the invention to provide a receptacle that permits the small undesirable objects to be captured away from the child, yet will allow larger objects to be maintained accessible to the child. In one embodiment, elongated objects, such as crayons or pencils, can be retained in an accessible position whereas smaller objects, such as marbles, crayon pieces, etc. will be captured within the receptacle. It is a further object of the present invention to provide the child-proof receptacle accessible to an adult for unlocking and disassembly to remove the captured objects from the canister interior.

These and other features of the present invention will become better understood with respect to the following description, appended claims, and accompanying drawings.

DETAILED DESCRIPTION OF THE PREFERRED EMBODIMENTS

Figure 1:
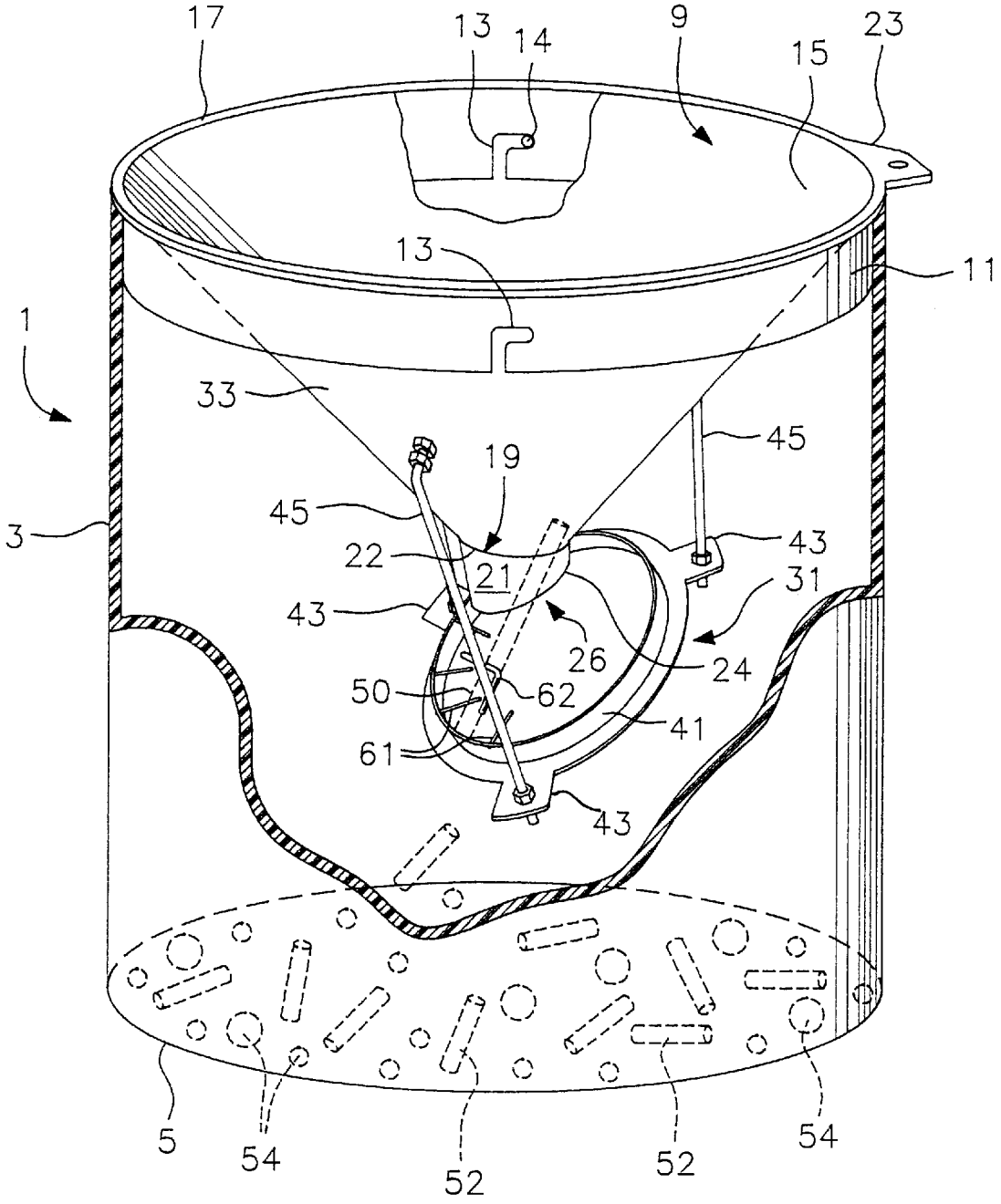
FIG. 1 is a partial cutaway perspective view of the receptacle including the canister and funnel-shaped insert locked to the canister.

The child-proof storage receptacle 1 includes a canister 3 that is preferably cylindrical with a closed off bottom wall 5 that sits on a floor or table surface, not shown. It is shaped somewhat like a wastebasket canister. It should be apparent that the shape could vary considerably, such as being angled outwardly in an upward direction or could be rectangular in cross-section. The canister has an open top edge 7. Secured adjacent the open top edge 7 of the canister 3 in a detachable manner is a preferably funnel-shaped insert 9. The funnel-shaped insert 9 is preferably detachably and lockably secured to the canister 3. That is, the canister 3 and the insert 9 cooperate to form a child-proof locking mechanism whereby the insert is secured to the canister adjacent the top edge in a manner that a child for whom the canister is designed to be utilized with will be unable to open the canister and be unable to remove or separate the insert 9 from the canister 3. In the embodiment shown, the funnel-shaped insert 9 includes a skirt portion 11 extending down from the perimeter 17 of the insert that includes bayonet-type cutouts 13 which will interlock with bayonets or rods, only one of which is shown at 14, that extend radially from the internal wall of the canister 3 in a known manner (not shown). Other locking arrangements can be used depending upon the need. For example, the funnel shaped insert 9 could include helical grooves in the skirt 11 that mate with corresponding helical grooves on the internal wall of the canister 3 near the top edge to screw the insert into the canister. If greater security is required, the insert can be actually locked to the top portion of the canister through various techniques such as a combination lock mechanism that would be insertable through openings in the wall and insert. Indeed, the insert could be screwed or bolted to the walls of the canister if extreme locking security is required. As the term is used herein, a child-proof locking mechanism is a locking mechanism of any arrangement that secures the insert 9 to the canister 3 but is of a geometry, weight or size that would not be unlocked by a child for whom the system is intended to be designed for. For example, if the child-proof storage receptacle is intended to be utilized with infants who are of small size and having minimal manual dexterity, a less secure type of locking mechanism may be utilized than would be utilized for a storage receptacle intended for use by kindergarten age children.

In each of the embodiments described herein, the canister 3 is of the same configuration as described above and the inserts are secured to the canister as described above. The embodiments differ due to the different insert configurations.

The interior wall 15 of the funnel-shaped insert 9 is tapered preferably in a conical manner in a direction from the top edge 17 of the insert 9 to an opening 19 at the center and bottom of the taper. The conical taper defines a major axis 20. The opening 19 has a preferably circular edge 22 of a predetermined diameter so as to prevent relatively larger objects from falling therethrough but permitting small objects having a size less than the diameter of the circular opening edge 22 in all material respects to fall into the canister 3 and to be captured within the canister 3.

In each of the preferred embodiments, a preferably axially-oriented extension 21 extends from the circular edge 22 and downwardly in a direction toward the bottom 5 of the canister. This extension 21 is formed integrally with the funnel-shaped insert 9. The extension 21 is substantially cylindrically shaped, i.e. the peripheral wall is parallel with the major axis 20 of the insert 9 or is tapered at a relatively lesser angle relative to the angle of taper of the funnel portion of the insert. Preferably the major axis 20 of the extension 21 coincides with the major axis 20 of the insert but may instead be inclined. The free end 24 of the extension defines an opening 26. In the first and third embodiments herein (FIGS. 1–3/FIG. 6) the free end 24, 224 is angled with respect to the vertical or major axis 20 of the insert 9.

The funnel-shaped insert 9 top edge 17 may include a hand gripping tab portion 23 to assist in removal of the insert from the canister.

Figure 2:
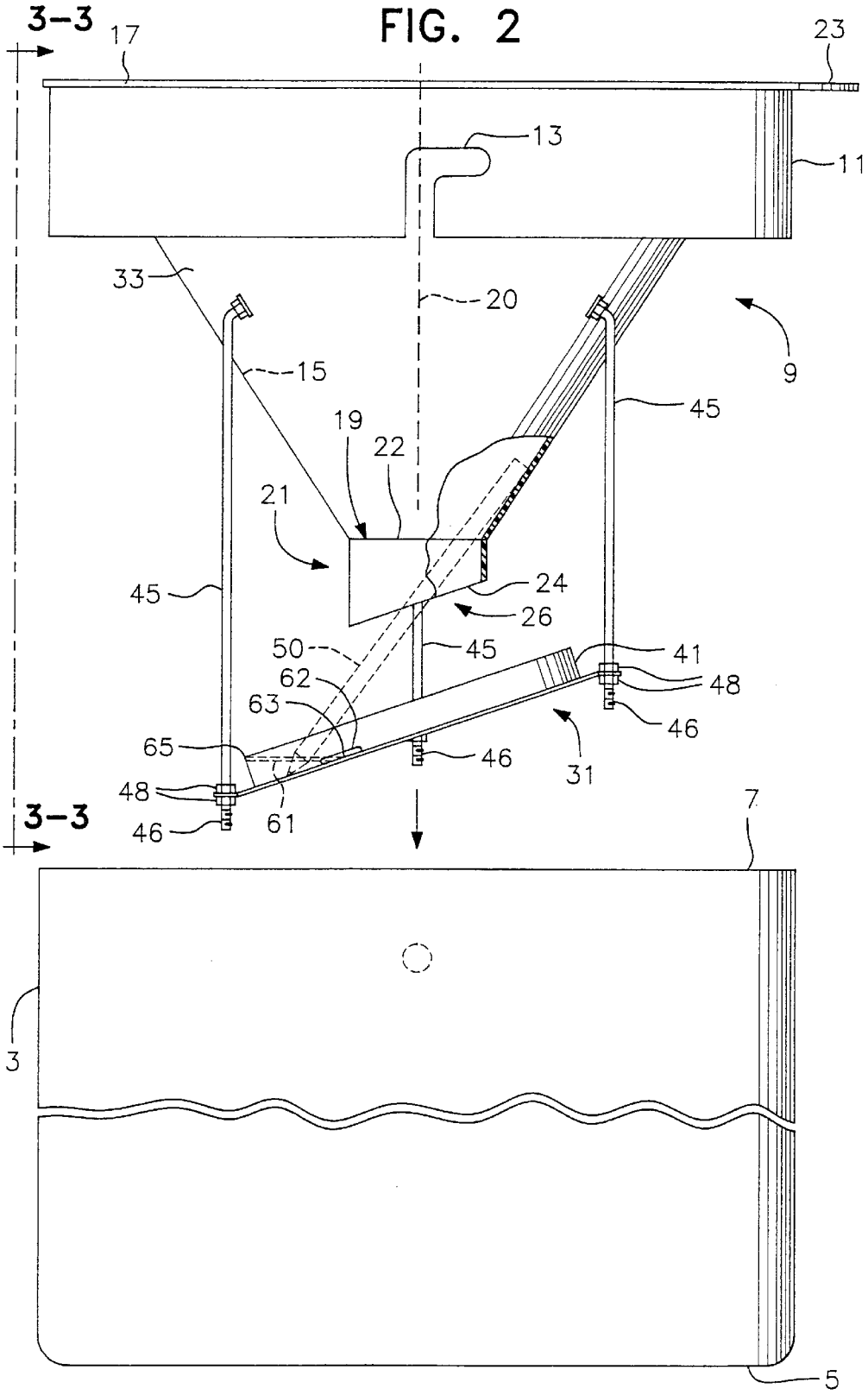
FIG. 2 is an exploded side view of the canister and funnel-shaped insert.
Figure 3:
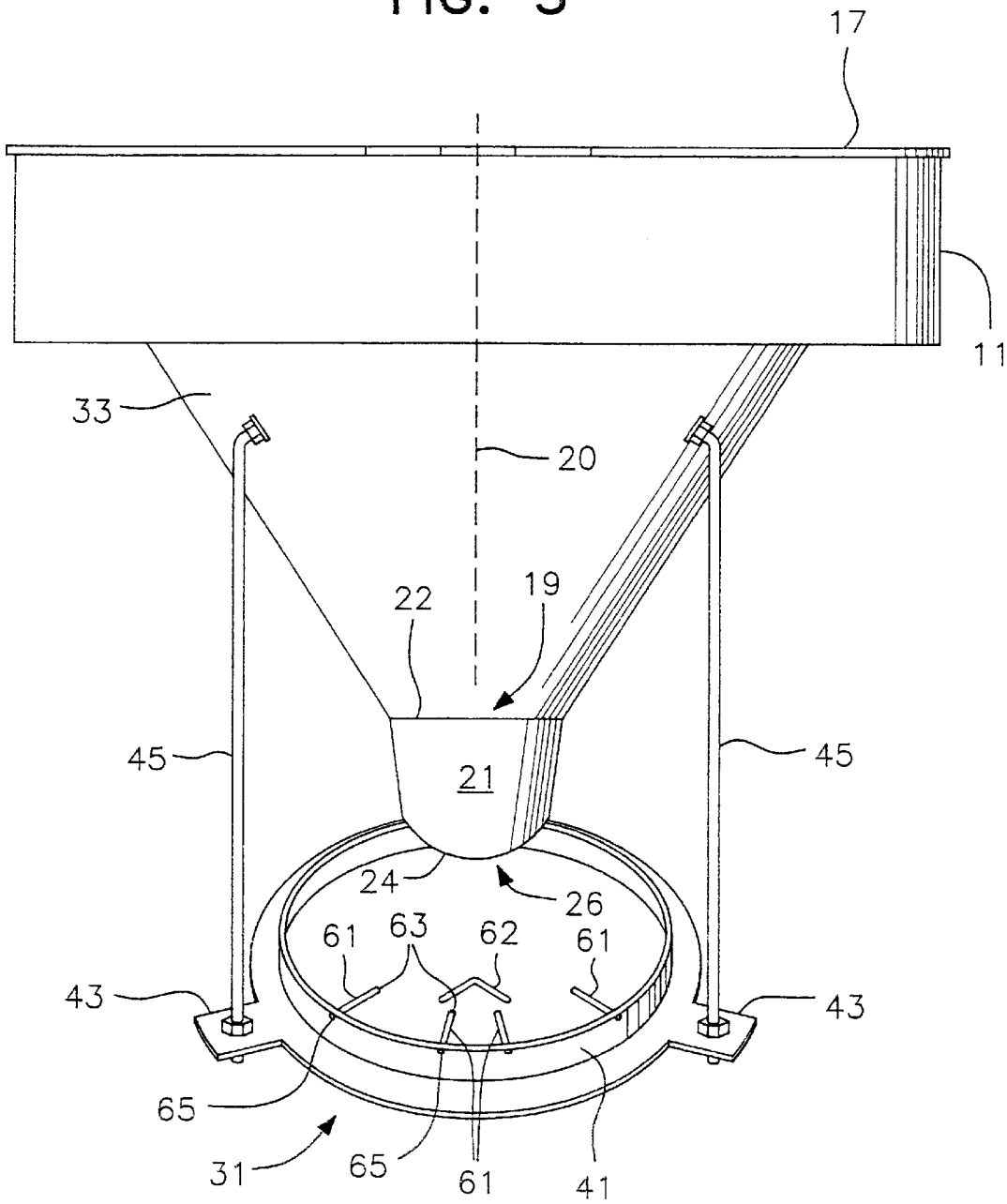
FIG. 3 is a view of the insert along line 3—3 of FIG. 2.

In the embodiment of FIGS. 1–3, a plate 31 is positioned within the canister and spaced below the funnel-shaped insert opening 19 and extension opening 26, and above the canister bottom 5, so as to intercept or be stricken by objects that are deposited into the insert and that roll down the insert tapered wall 15 and pass through the openings 19 and 26. The plate 31 is angled or inclined relative to vertical, i.e. relative to the major axis 20 of the cone-shaped insert 9 or to the bottom planar base 5 of the canister. Preferably, the plate 31 is angled the same as the opening 26 defined by free end edge 24 and oriented the same direction. Preferably, the plate 31 is fixed to and suspended from the underside 33 of the funnel-shaped insert as is depicted. This is not strictly required and the plate 31 could be supported by the walls of the canister, either the side walls or even from the bottom wall. Preferably, the plate 31 has a circular perimeter and the plane of the plate is parallel with the plane defined by the free end edge 24. The plate 31 includes an upstanding lip 41 adjacent the plate perimeter that fully extends around the plate and is oriented upward in a direction toward the insert, substantially perpendicular to the plane of the plate 31. Although the plate 31 is shown as substantially circular, if the canister 3 is of a rectangular cross-sectional shape, the plate 31 could be correspondingly rectangular. The opening 19 and the opening 26 could each be of a non-circular or non-oval shape corresponding generally to the overall shape of the canister.

The plate 31 includes, in a preferred embodiment, three tabs 43 extending radially from the plate edge which are used to connect three arms 45, for example, that extend from the underside 33 of the funnel-shaped insert 9 for attachment to the plate 31. Preferably, but not shown, the funnel-shaped insert 9, the plate 31 and the arms 45 that connect the plate 31 to the insert 9 are formed integrally from a plastic-like material. This is not strictly required and other materials can be used. As shown, the arms 45 that extend from the insert 9 have threaded portions 46 that extend into openings within the radially extending tabs, secured by nuts 48, instead of being integrally formed. The employment of threaded rods allows for adjustment in an axial direction of the plate 31 with respect to the opening 26. Other attachment techniques could be employed without departing from the scope of the present invention.

The purpose of the lip 41 is to assist in retaining elongated objects such as pencils or crayons as shown by 50 in FIGS. 1 and 2, disposed on the plate 31 so that an end of the elongated object exits the opening 19 within the funnel-shaped insert 9. This enables the elongated object to be retained for access by the child or the parent. These elongated objects, such as object 50, are not intended to fall within the interior of the canister so as to be captured by the canister. On the other hand, smaller objects such as pieces of a crayon 52 or marbles 54, etc. that fall within the insert 9 are intended to roll down the plate 31 and into the canister. The lip 41, however, might have a tendency to prevent a relatively small irregularly shaped object, such as a crayon piece, from falling into the canister interior. Accordingly, a plurality of relatively thin rods, which may be circular in cross-section, are disposed on the plate extending between the plane of the plate and the upper portion of the lip, near the bottommost orientation of the plate. Alternatively, these rods may be cut-outs of the planar plate, and thus rectangular in cross-section. That is, one end 63 of a ramp 61 is at the plane of the plate 31, angled upward to contact the lip 41 at or adjacent the top edge 65. The rods act as ramps 61 that cause small objects to roll or fall over the lip 41. In addition to the ramps 61, raised projections 62 which may be formed as indentations from the underside of the plate projecting upward from the top side of the plate in a V-shape to act as obstacles to change the trajectory of the small objects. This way, if a small object such as a small crayon or a marble falls down onto the plane of the plate 31, it is likely to strike one of the obstacles or projections 62 and be deflected to roll and, with or without the help of the ramps 61, to fall over the edge of the lip. If a larger elongated object were to strike a ramp 61, there is little or no danger that it would fall into the interior of the canister since it will likely be displaced in a sideways manner, i.e. angularly oriented as opposed to a radial free fall, to catch the lip 41. So long as the rods forming the ramps 61 are narrow, an elongated object, such as 50, will be deflected in a sideways manner to contact the lip edge and be retained on the plate. In contrast, small objects will be deflected to bounce over the lip 41.

There are a number of geometric variables that can be adjusted depending upon the size and configuration of the objects to be retained within the canister 3, the larger objects (not shown) to be retained in the funnel-shaped insert, and the intermediate-sized elongated objects 50 to be partially supported by the underlying plate 31 to stick out from the opening 19 so as to remain accessible to the child. For example, the diameter of the opening 19 needs to be sized to enable the objects to fall through yet retain larger objects above the opening. For example, a tennis ball is not intended to fall through and be retained within the canister and the diameter of the opening 19 would be less than the size of the ball diameter to prevent the ball from passing therethrough. On the other hand, objects to be retained, such as marbles, small erasers for example, would require that the opening 19 be of a diameter greater than the diameter or any dimension of such retainable objects. Certain objects, particularly elongated objects are intended to be accessible to the child. As is shown in the drawings, a pencil 50 is retained by cooperation of the pencil 50 with the lip 41 of the underlying plate 31 and the circular edge 22 of the insert opening 19 or the interior wall 15. Thus, the plate 31 should not be positioned too low within the canister to prevent the elongated objects from resting between the lip 41 and the circular edge 22 or wall 15. Moreover, the diameter of the plate 31 should be sized so that the article to be retained intersects or rests against the lip 41.

The height of the lip 41 and the angle of inclination of the plate 31 are also factors that may be adjusted in final design. The plate angle of orientation enables articles to accelerate downwardly at a particular rate so as to fall over the top of the lip 41, with or without help of the ramps 61 or obstacle projections 62, and thus be retained within the canister 3 and not rest on the lip 41. Indeed the diameter of the plate 31 can also be varied.

The determination of the size of the opening 19, the plate 31 diameter, the lip 41 height, the position of the plate 31 with respect to the opening 26, the angle of orientation of the plate 31 and the opening 26 defined by the free edge 24, and the axial dimension of the extension 21, are variables to be determined empirically depending upon the size of the objects to be retained within the canister and accessible to the child. It should be appreciated that the angle of the free edge 24 determines the exit angle of objects, especially elongated objects, from the insert 9 so as to be captured by the plate lip. The angle of the opening 26 and plate 31 can vary and is determined empirically. The plate is angled preferably the same amount.

In a variation, not shown, of this first embodiment, the plate, instead of being flat such as plate 31, could be conically-shaped, oriented substantially perpendicular to the major axis of the funnel-shaped insert so that the apex of the cone lies closest to the opening 26. That is, instead of the plate being flat and angled with respect to the major axis, the plate may be a cone-shaped configuration and will be oriented perpendicular to the major axis of the funnel-shaped insert. A circular rim or lip would also be utilized and optionally a series of ramps would be radially disposed 360° about the peripheral edge. When using a plate of this variation, the free end 24 of the extension would preferably not be inclined but, rather, would define an opening, the plane of which would be substantially perpendicular to the major axis of the funnel-shaped insert.

Figure 4:
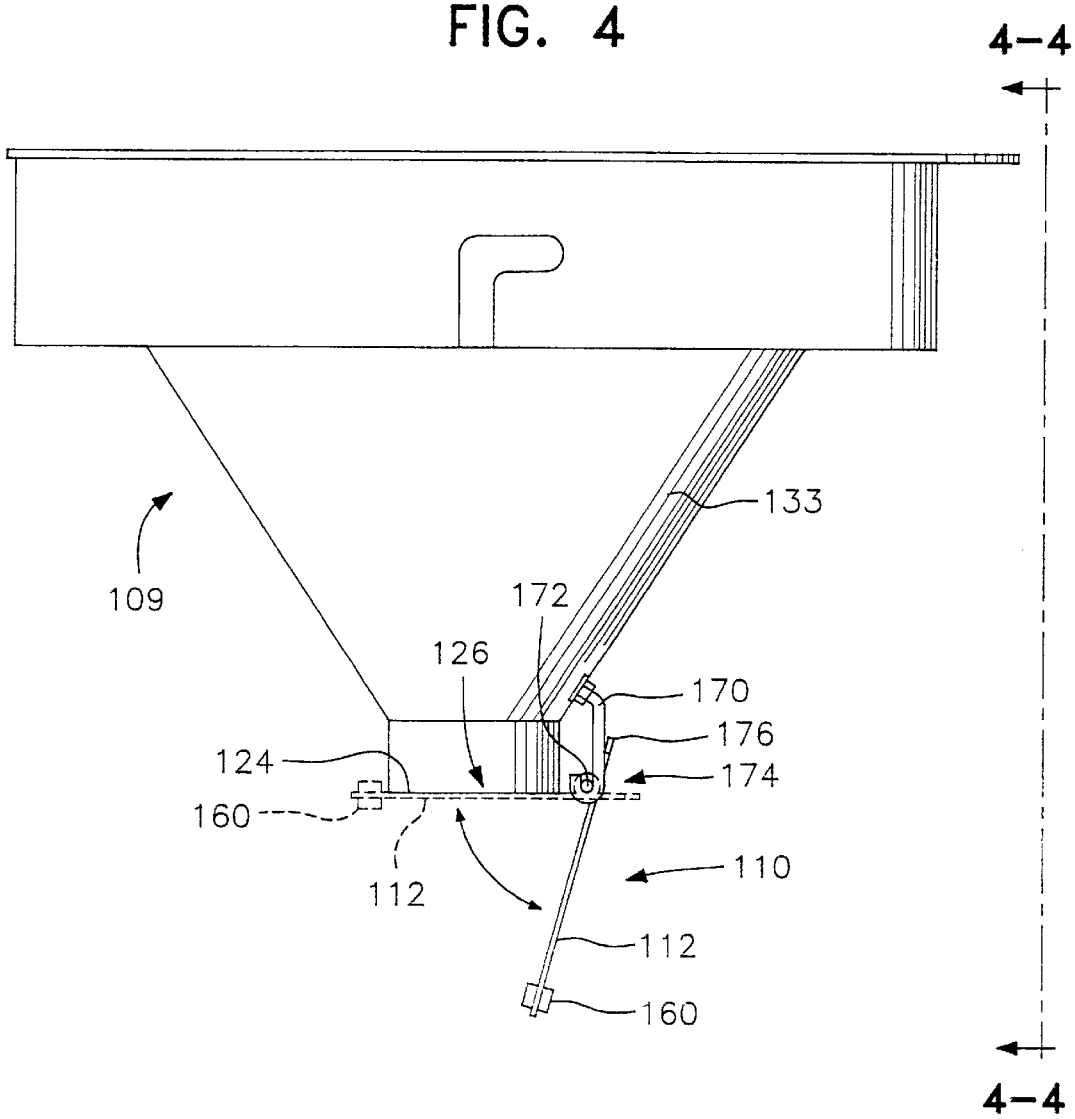
FIG. 4 is a side view of a second embodiment of a funnel-shaped insert for insertion and locking to the canister.
Figure 5:
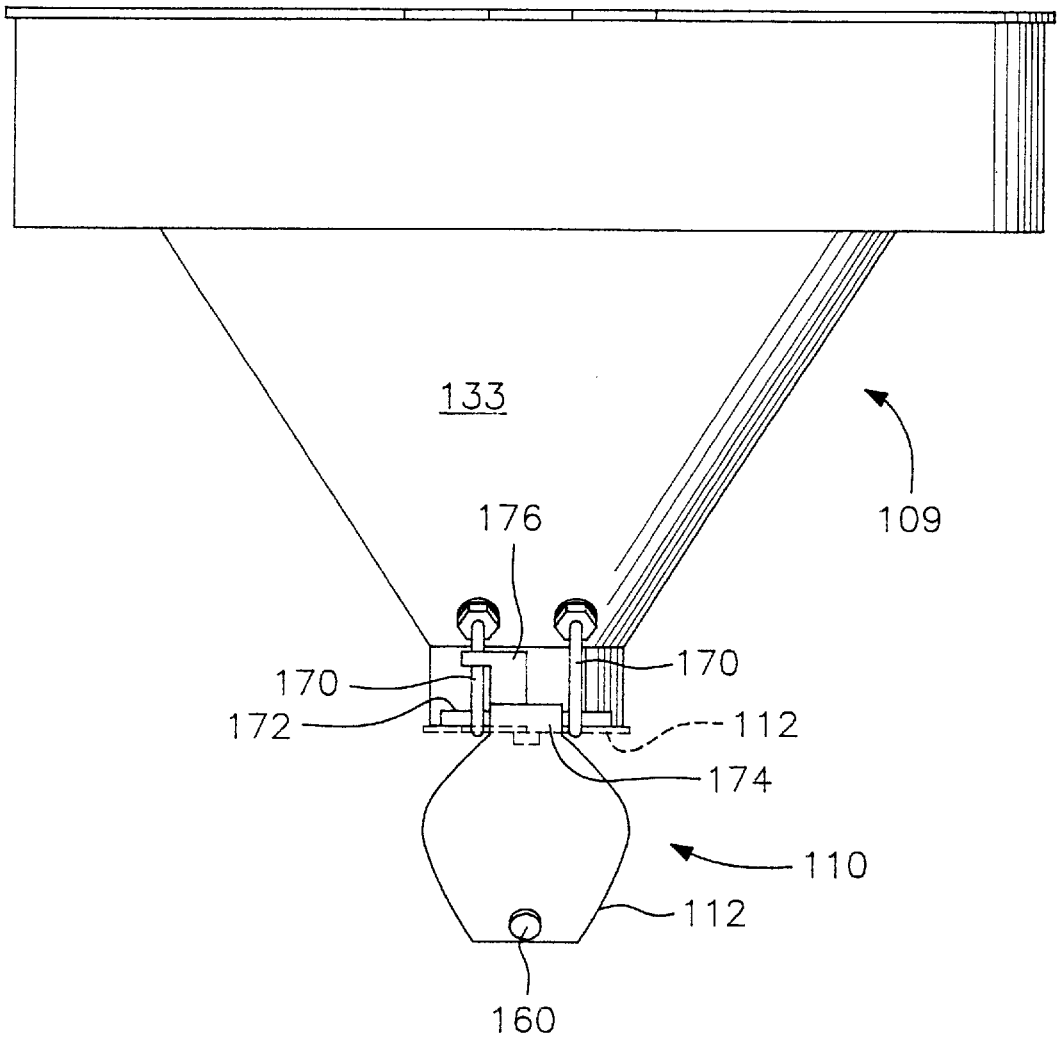
FIG. 5 is a view along line 4—4 of FIG. 4.

Turning next to the second embodiment as shown in FIGS. 4 and 5, no plate underlying the funnel-shaped insert 109 is provided. In this embodiment, the funnel-shaped insert 109 is generally the same as that described above except that the free end 124 defines an opening 126 that is substantially perpendicular to the major axis of the conical or funnel-shaped insert 109. A cap 110, preferably a planar flap 112, which is of sufficient area to overlie the opening 126 is freely pivotally attached to the underside of the funnel-shaped insert such as to the extension 21 or, as shown, exterior side wall 133 of the funnel-shaped section 109. As shown, two arms 170 extend from the exterior funnel wall 133, which arms 170 support a pin or rod 172. The cap 110 has a cylindrical portion 174 which is sized so as to freely pivot about the rod 172. The cap 110 is shown weighted at 160 at a peripheral edge opposite the hinge pin 172 so that the cap freely extends in a downward direction as shown in solid lines. The cap 110 includes a stop member 176, shown L-shaped, to prevent the cap 110 from assuming a completely vertical orientation. Other devices to stop the cap 110 from assuming verticality can be used. For example, one of the arms 170 can have a downwardly extended portion, angled slightly toward the major axis, to contact the cap 110 to intercept its free fall so as to prevent a vertical orientation. That is, it is preferred that the cap be hanging downward at a slight under vertical or inclined position. With this embodiment, if the child-proof receptacle is inverted or turned over by the child, the cap or flap will, by the weight of gravity, automatically fall down onto the opening 126 and substantially seat against the edge 124 to prevent articles from passing outward as is shown by the dotted lines. The weight of the cap 110 is intended to be sufficiently great so that normal shaking of the canister (not shown) in its inverted position will not unseat the cap 110, at least completely and thus permit articles to fall out.

Although the cap 110 shown to be a relatively thin flap 112 with a weight 160 on one edge of the perimeter, it should be appreciated that the overall weight of the cap 110 could be uniformly distributed, or may be a lip about the entire periphery of the cap. It is only preferred that the overall weight of the cap 110 be sufficient to cause it to hang downward, as shown in solid lines, when the canister is upright and to seat on the edge 124 to cover the opening 126, as shown in dotted lines when the canister is inverted and to be sufficiently resistant against unseating if the canister is slightly shaken.

Figure 6:
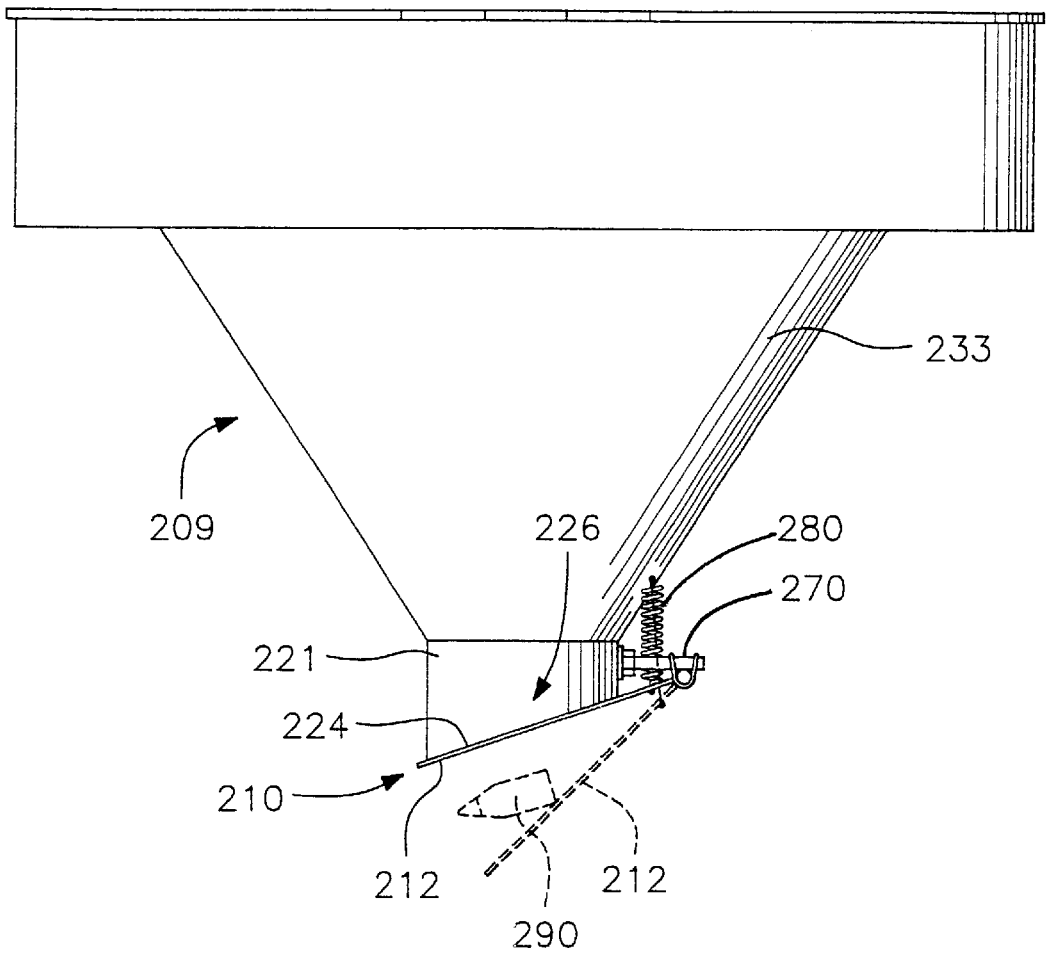
FIG. 6 is a side view of a third embodiment of a funnel-shaped insert for insertion and locking to the canister.

Another embodiment of the invention is depicted in FIG. 6 which also shows only the insert 209 without the canister. In this embodiment, which is somewhat similar to the embodiment of FIGS. 4 and 5, the cap 210 which is shown as a thin flap 212 is substantially oval-shaped and may be connected either to the substantially cylindrically shaped axially oriented extension 221, as shown through arms 270 or directly to the funnel-shaped insert 9 by a pivot or hinge that is spring-biased to cause the cap 210 or flap 212 to cover or partially cover the insert opening 226 when the canister is in its normal upright position as shown in solid lines. In the embodiment shown, the flap 212 is light-weight and has an extension spring 280 connected from the flap 212 to the wall 233 of the funnel-shaped insert to bias the flap closed. It should be apparent that other spring arrangements can be utilized to retain the flap 212 biased against the edge 224 and thus to close off the opening 226. For example, the spring could be a well-known helical spring (not shown) with two free ends that bias the flap in a closed position with respect to the opening 226. In the embodiment of FIG. 6, the flap 212 is intended to be very light weight and the countervailing force of the spring 280 is just equal to the weight of the flap 212 so that the resultant force vector acting on the flap 212 is neutral and the flap 212 is, in a static condition, either disposed against the edge 224 as shown or, preferably, spaced slightly to leave a small gap between the flap and the edge 224. That is, the force of the spring 280 should counteract the force that gravity exerts on the flap 212 when the canister is in its normal upright position such as when the canister rests on the floor. This allows the flap 212 to be very sensitive to the weight of light objects so that light objects can move the flap to enable the objects to pass through the opening 226 when the objects impact upon plate. As shown in dotted lines in FIG. 6, a light weight such as a piece of crayon 290 is sufficient to overcome the force exerted by the spring 280 so that the weight of the crayon 290 and the weight of the flap 212 overcome the spring-bias upward force and allow the small crayon piece 290 to fall into the canister (not shown). When the canister is inverted, the weight of the cap 210, i.e. flap 212 acts with the bias of the spring 280 to keep the cap closed thus preventing objects from falling out.

In the second and third embodiments discussed above, the omission of an underlying plate does not permit elongated objects from sticking out into the funnel-shaped insert area for removal. On the other hand, these latter two embodiments provide a greater security against articles being removed when the canister is inverted and shaken.

The invention is not limited to the specific preferred embodiments as described above but is only limited as defined by the following claims.

What is claimed is:

1. A child-proof storage receptacle comprising:

a canister having a bottom wall and an open top;

an insert having a substantially funnel-shaped region within the canister and secured to the canister adjacent the open top by a child-proof locking mechanism wherein the insert tapers to an opening sized to receive objects to be retained within said canister;

a plate positioned within said canister and spaced below the insert opening and above said canister bottom wall so as to intercept objects deposited into the insert that pass through said opening, said plate suspended from said insert;

wherein said insert includes a substantially conical wall defining a major axis perpendicular to the canister bottom wall, and said plate is substantially planar having a substantially circular perimeter, wherein said plate is inclined with respect to the major axis of said insert.

2. The child-proof receptacle of claim 1 wherein said plate includes a lip about its perimeter extending substantially perpendicular to the plane of said plate in a direction toward said opening.

3. The child-proof receptacle of claim 2 wherein said insert opening is defined by a circular edge.

4. The child-proof receptacle of claim 3 wherein said insert opening circular edge has a predetermined diameter sized so as to prevent relatively larger objects from falling therethrough.

5. The child-proof receptacle of claim 3 wherein said insert includes a substantially cylindrically-shaped axially-oriented extension from said circular edge toward said plate, the free end of said extension having an edge defining a second opening, said second opening lying in a plane inclined with respect to said major axis of said insert.

6. The child-proof receptacle of claim 5 wherein said plate is of a predetermined diameter and inclined at a predetermined angle, and positioned a predetermined distance below said insert second opening, and the lip is of a predetermined height, so as to capture relatively-elongated objects between said circular edge and lip and prevent such elongated objects from falling entirely into said canister.

7. The child-proof receptacle of claim 6 wherein said plate includes a plurality of ramps extending from the plane of the plate to an edge of the lip so as to enable objects intended to be retained within said canister to fall down the inclined plate and over the lip.

8. A child-proof receptacle for capturing objects to be inaccessible to children, and for enabling relatively larger objects to remain accessible to children, said child-proof receptacle comprising:

a canister having a top edge and a bottom planar support surface and an insert detachably secured to the canister, said insert having an internal wall extending from the top edge of the canister, said internal wall having a downwardly sloping portion, said internal wall further including an opening sized to receive objects to be captured within the canister;

a planar plate positioned within said canister below said opening, said plate inclined with-respect to said bottom planar support surface, said plate including a circumferential lip adjacent the perimeter of said plate, wherein said plate is positioned a predetermined distance below said opening, at a predetermined incline, and said lip is of a predetermined size, such that relatively larger objects will be retained by said plate to extend out of said opening into the interior of said insert so as to be accessible.

9. The child-proof receptacle of claim 8 wherein said plate includes a plurality of substantially radially-oriented ramps that extend from the plane of the plate, adjacent said lip, to a top edge of said lip.

10. The child-proof receptacle of claim 9 wherein said ramps are circular rods.

11. The child-proof receptacle of claim 8 wherein said opening lies in a plane substantially parallel to said plate.

12. A child-proof receptacle for capturing objects to be inaccessible to children comprising, a canister having a bottom base and a side wall defining a top edge;

an insert detachably secured to said canister adjacent said top edge, said insert having a downwardly sloping wall and an opening that provides for a passage between the insert interior and the canister interior to enable objects to pass through the opening into the canister interior, said insert including a cap pivotally connected adjacent said opening, said cap closing off said opening at least when said canister is inverted to prevent objects captured within said interior from passing back outwardly through said opening.

13. The child-proof receptacle of claim 12 wherein said cap is a substantially planar flap.

14. The child-proof receptacle of claim 13 wherein said flap is pivotally connected adjacent said opening to freely hang downwardly into the canister interior, said flap of sufficient weight to fall over the opening to enclose the opening when the canister is inverted.

15. The child-proof receptacle of claim 14 wherein said cap hangs downwardly at an angle less than 180° and inclined in a direction toward said opening.

16. The child-proof receptacle of claim 12 wherein said cap is a spring-biased flap to substantially close-off said opening when said canister is upright, said spring-bias imposing an upward force vector component magnitude equal to the downward force vector component magnitude attributed to the weight of the cap.

17. A method for retaining small objects to be inaccessible to children, the method comprising the steps of:

providing a storage canister having an opening at the top;

inserting a substantially funnel-shaped insert into the canister to cover the opening, said insert having a bottom opening;

securing the insert to the canister so as to be incapable of removal from the canister by a child;

placing elongated objects within the funnel-shaped insert such that small objects that are to be kept inaccessible fall through the bottom opening and are retained within the canister, while the elongated objects are retained in the funnel-shaped insert and extend from the opening into the funnel-shaped insert for access with no part of such objects passing through the opening.

* * * * *